US007198077B1

(12) United States Patent
Uzkan et al.

(10) Patent No.: US 7,198,077 B1
(45) Date of Patent: Apr. 3, 2007

(54) FILLER APPARATUS FOR MULTIPLE CHAMBER RECEPTACLES

(76) Inventors: Levent T. Uzkan, 845 Bluestrem Dr., Bolingbrook, IL (US) 60440; Joseph J. Koy, 839 Bluestem Dr., Bolingbrook, IL (US) 60440; Raymond E. Gabert, 1712 Ronzheimer, St. Charles, IL (US) 60174

( * ) Notice: Subject to any disclaimer, the term of this patent is extended or adjusted under 35 U.S.C. 154(b) by 307 days.

(21) Appl. No.: 10/927,909

(22) Filed: Aug. 27, 2004

Related U.S. Application Data

(60) Provisional application No. 60/501,179, filed on Sep. 8, 2003.

(51) Int. Cl.
*B65B 1/04* (2006.01)

(52) U.S. Cl. ..... 141/248; 141/94; 141/100; 141/171; 141/240; 222/481; 222/485; 222/529

(58) Field of Classification Search ..... 141/2, 141/9, 18, 94, 100, 171, 234, 240, 248; 222/145.4, 222/429, 481, 485, 478, 529, 537; 414/299
See application file for complete search history.

(56) References Cited

U.S. PATENT DOCUMENTS 2,749,005 A * 6/1956 Plusquellic ..... 141/180
3,294,292 A * 12/1966 Adams et al. ..... 222/429
4,884,602 A * 12/1989 Yamamoto et al. ..... 141/242
4,958,999 A * 9/1990 Liscomb et al. ..... 425/110
6,126,375 A * 10/2000 O'Brien ..... 414/299

* cited by examiner

*Primary Examiner*—Timothy L. Maust
(74) *Attorney, Agent, or Firm*—F. David Aubuchon

(57) ABSTRACT

An improved machine and method for automatically proportioning-out or measuring-out a predetermined quantities of a variety of selected products and feeding the predetermined quantities of product into the individual chambers of a multiple-chamber dispensing container. The multiple-chamber dispensing containers are fed by a conveyor that is driven by a stepper-motor, to the filling location. The filling cycle begins when an empty container is recognized by a sensing mechanism. The machine and method causes the measured products to be deposited simultaneously into all of the individual chamber of the multiple-chamber dispensing container. The cycle is completed at a predetermined time period after the container was recognized. When a cycle has been completed the conveyor is energized. The next cycle begins when the next container is recognized.

15 Claims, 6 Drawing Sheets

FILLER APPARATUS FOR MULTIPLE CHAMBER RECEPTACLES

RELATED APPLICATIONS

Priority is claimed under Provisional Application No. 60/501,179, filed on Sep. 8, 2003.

BACKGROUND OF THE INVENTION

The present invention relates to a novel apparatus for automatically proportioning-out predetermined quantities of different products and discharging the predetermined quantities into individual chambers of a multiple-chamber dispensing containers. Multiple-chamber dispensing containers are known and are disclosed for example in U.S. Pat. Nos. 4,583,667, 4,522,315, 4,261,468 and 3,878,971.

BRIEF SUMMARY OF THE INVENTION

In accordance with the present invention a novel and useful apparatus and method for automatically proportioning-out or measuring-out a predetermined quantities of a variety of selected products has been provided. The predetermined quantities correspond to the volume of the individual chambers of a multiple-chamber dispensing container into which the apparatus automatically discharges the measured product. The apparatus simultaneously discharges the measured products into each individual chamber of the multiple-chamber dispensing container. The multiple-chamber dispensing containers are fed to the measuring and dispensing device by a conveyor that is driven by a stepper-motor. The stepper-motor conveyor is controlled by an apparatus control system. Individual multiple-chamber dispensing containers are sensed by an optical-sensor causing a signal to be sent to the apparatus control system which then stops the conveyor with the sensed multiple-chamber dispensing container properly aligned with the measuring and dispensing device. The measuring and dispensing device is programmed to dispense the measured products into the individual chambers after the multiple-chamber dispensing container has stopped. This dispensing can be programmed to occur simultaneously with stopping the container or at a predetermined time after the container has been stopped. The apparatus control system is programmed to energized the conveyor after a predetermined dispensing time period, causing the filled multiple-chamber dispensing container to move past the measuring and dispensing device and an empty multiple-chamber dispensing container to advance and be recognized by the optical-sensor. When the empty multiple-chamber dispensing container is recognized, by the optical-sensor, the cycle is repeated.

DETAILED DESCRIPTION OF THE INVENTION

Figure 2:
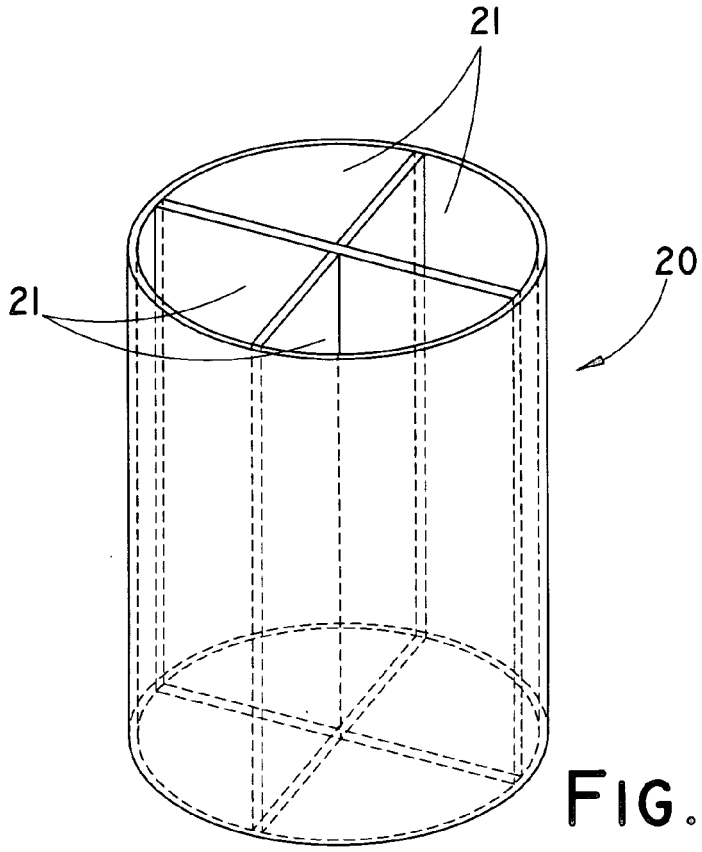
FIG. 2 is a perspective view of a four-chamber multiple-chamber container of the type that the illustrated embodiment of this invention is set up to fill.

The apparatus of the present invention is capable of automatically accurately proportioning-out or measuring-out predetermined quantities of a large variety of products and automatically discharging the predetermined quantities into individual chambers of multiple-chamber containers. The products that can be processed by this apparatus can be granular such as sugar, small candy or varieties of spices. Multiple-chamber containers of the general type that are filled by this apparatus are known and are commonly available in three, four and six chamber sizes. Although the apparatus of this invention can fill containers having any number of chambers, the apparatus that is illustrated and discussed in detail herein is set up to fill multiple-chamber containers having four chambers. A multiple-chamber container 20, having four individual chambers 21, of the type that could be filled by the illustrated embodiment of this invention is illustrated in FIG. 2. It should be noted that the number of chambers as well as the diameter and height of the multiple-chamber container 20 can also be selected as desired.

A preferred embodiment of the invention will now be discussed with reference to FIGS. 1 through 9.

Figure 1:
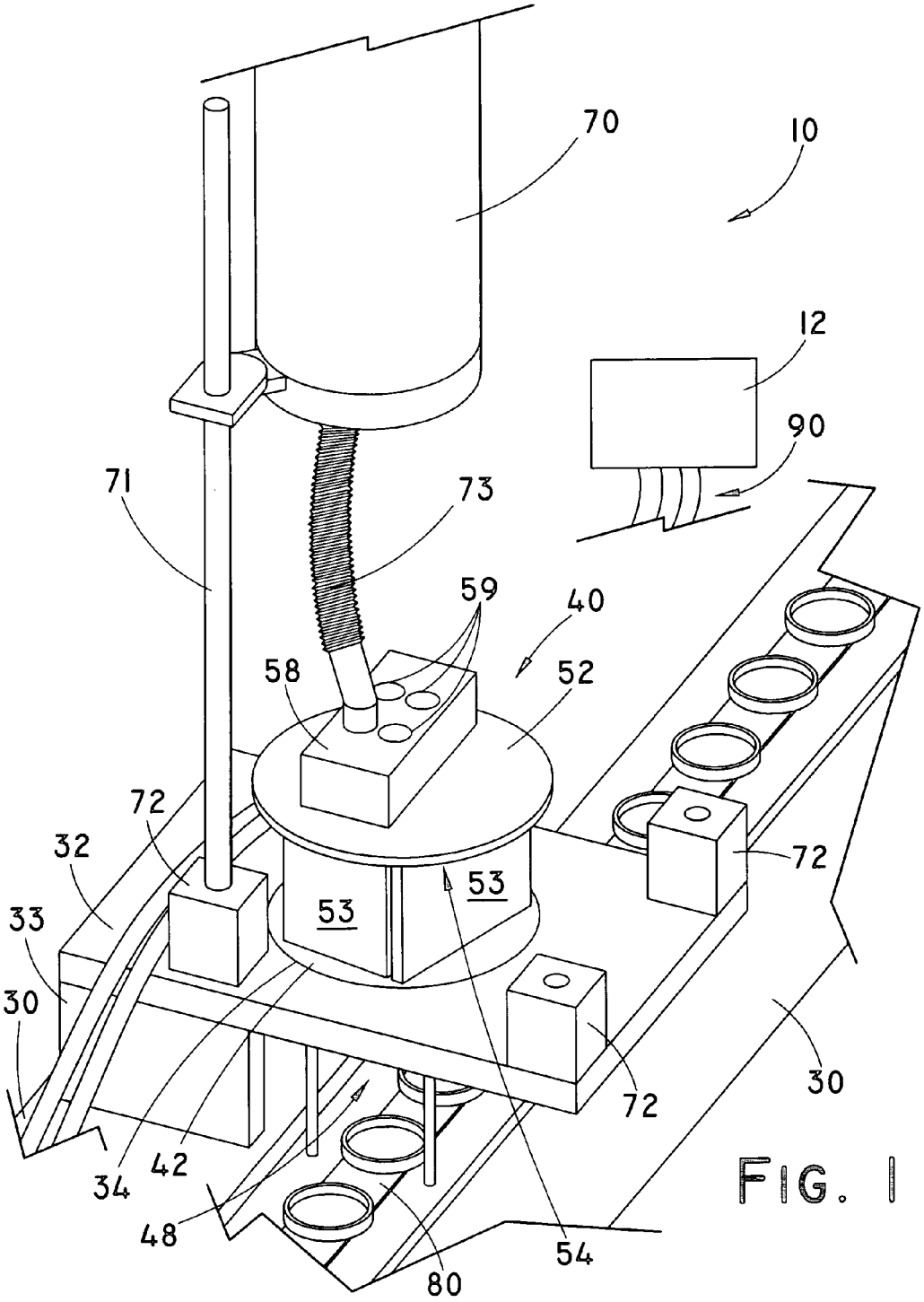
FIG. 1 is a perspective view of the apparatus that is set up for a four-chamber dispensing container, showing, for clarity of the view, only one of the four supply hoppers and conduits.

FIG. 1 illustrates a perspective view of the apparatus 10. The illustrated apparatus has been set up to fill containers having four chambers of the general type that is illustrated in FIG. 2. It should be noted that in FIG. 1, a single product feed device 70 carried by a support rod 71 extending upwardly from a mounting block 72 and including a flexible feed conduit 73 has been included in the illustration. The other three product feed devices 70 are identical to the one illustrated are not included in the illustrated apparatus to simplify the drawing and not obscure other features of the apparatus. Two of the other mounting-blocks 72 are included in the illustration.

The apparatus 10 includes a sensing mechanism 86, and shuttles 60 that are caused to reciprocate by mechanism 68 that are interconnected to an apparatus control system 12 that is symbolically illustrated in FIG. 1.

Figure 3:
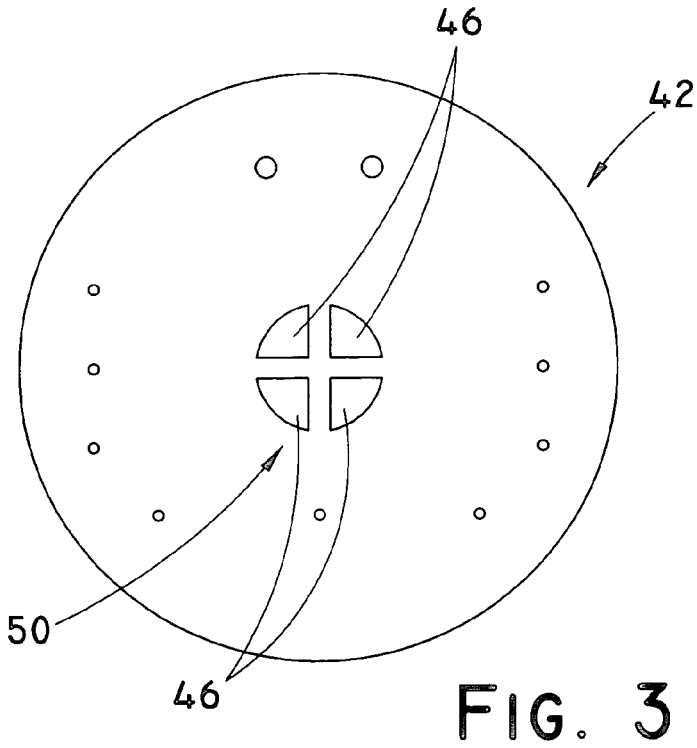
FIG. 3 is an isolated plan view of the bottom plate.

The measuring and dispensing device 40 and the conveyor 80 are supported by a frame or frames 30. The measuring and dispensing device 40 is carried by a mounting plate 32 that is supported by plates 33 that extend upwardly from the frame 30 such that a portion of the mounting plate 32 is cantilevered over the portion of the frame 30 that carries the conveyor 80. A large circular aperture 34 is formed in the mounting plate 32 above the conveyor 80. Aperture 34 includes a groove that receives the bottom plate 42 an isolated plan view of which is shown in FIG. 3. The bottom plate 42 rests in the groove formed in the aperture 34, such that it can be rotated relative to mounting plate 32. Rotation of the bottom plate in aperture 34 allows proper adjustment of the sensing mechanism 86 relative to the multiple-chamber containers. The sensing mechanism 86 is fixed to the bottom plate 42 and the multiple-chamber containers 20 must be orientated in the cups 81 of conveyor 80 such that the sensing beam passes through the plane of a vertical divider wall forming the multiple-chambers. As best seen in FIG. 3 the bottom plate 42 has four pie-shaped openings 46 formed therein as well as a number of bolt holes, for bolting the device together. The shape defined by the four pie-shaped openings 46 is referred to as the pattern 50 for this embodiment. Openings 46 correspond in shape and size to the individual chambers 21 in the multiple-chamber container 20. Each multiple-chamber container 20 carried by the conveyor 80 will stop below the measuring and dispensing device 40 with the openings 46 aligned with the individual chambers 21 and the product will flow through openings 46 into the individual chambers 21. This location is referred to as the container filling location 48. The upper surface 44 of the bottom plate 42 must be smooth for a purpose to be further discussed.

Figure 4:
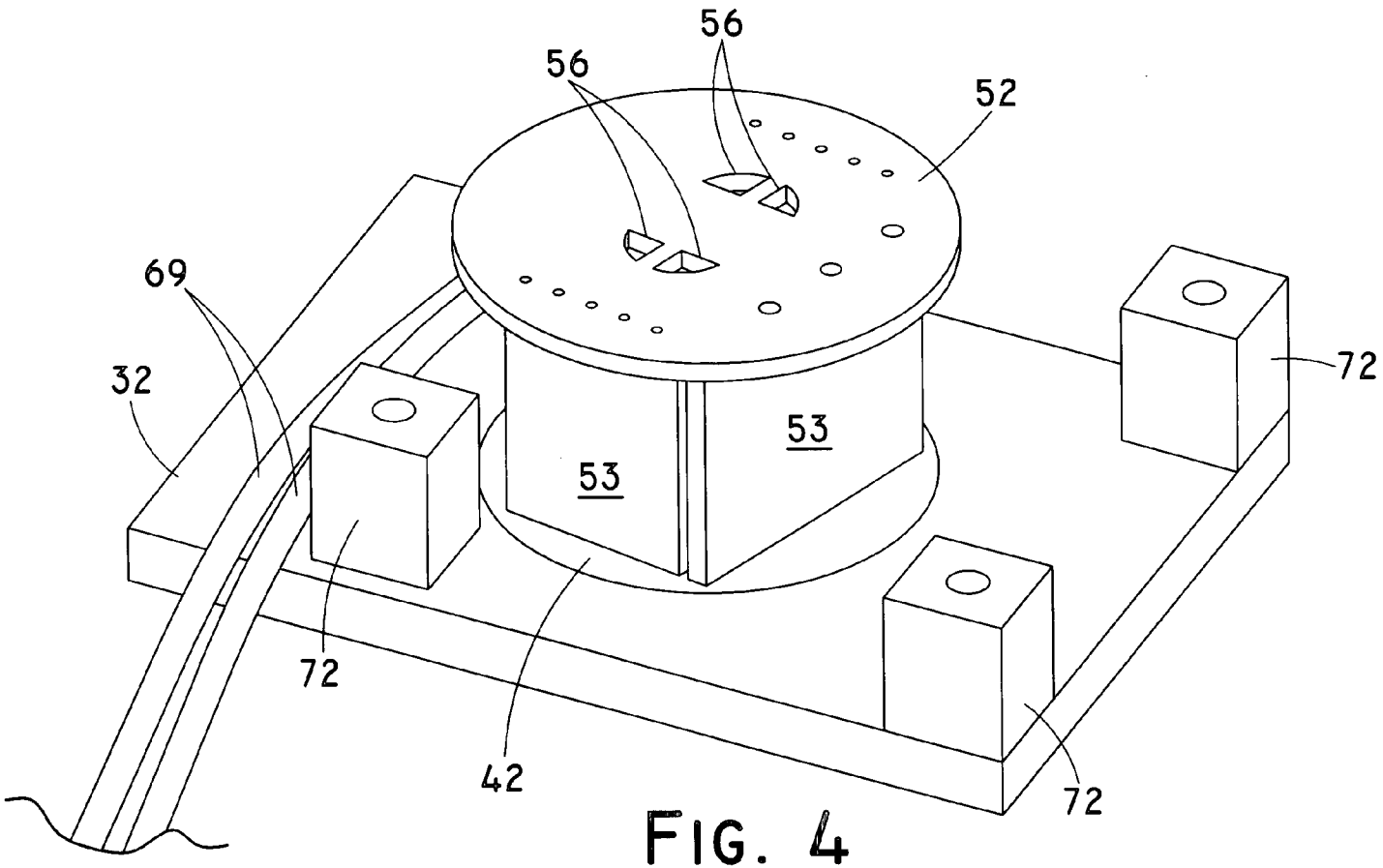
FIG. 4 is a perspective view of a portion of the measuring and dispensing device including a unobstructed view of the upper surface of the top plate.
Figure 5:
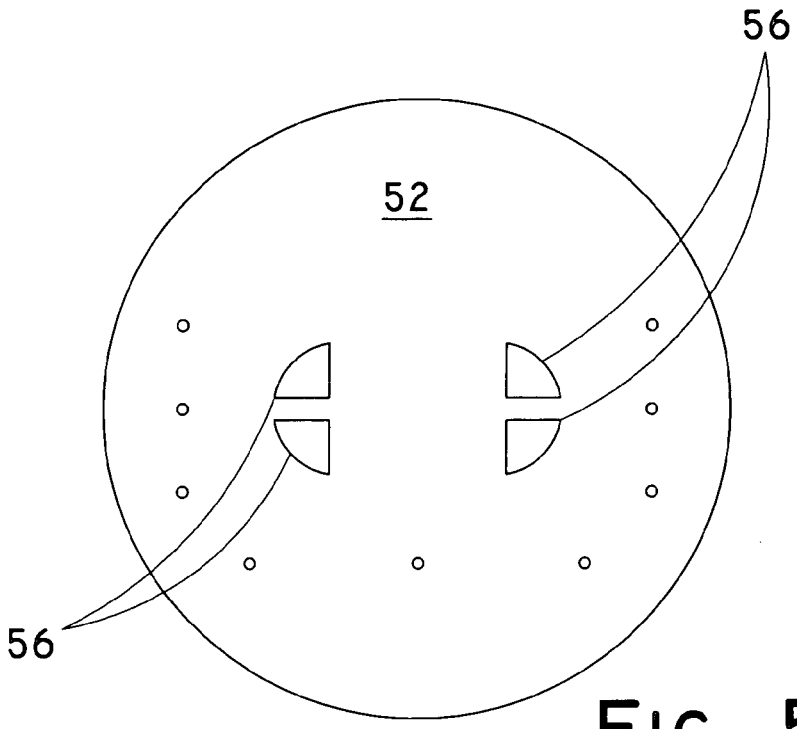
FIG. 5 is an isolated plan view of the top plate.
Figure 6:
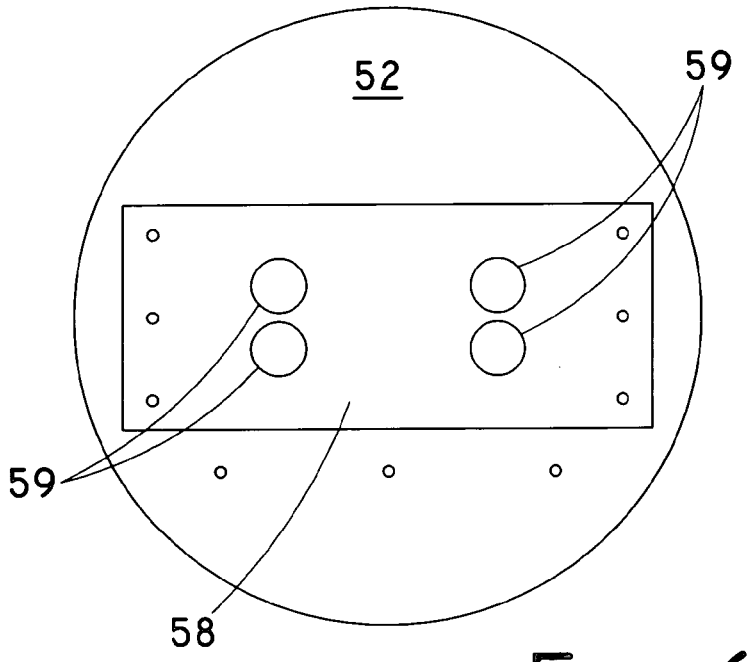
FIG. 6 is an isolated plan view of the top plate with the transition-block attached.

As seen in FIG. 1 a top plate 52 is supported above bottom plate 42 by three vertical support plates 53, only two of which can be seen in FIG. 1. A perspective view of a portion of the measuring and dispensing device including an unobstructed view of the upper surface of the top plate 52 and an isolated plan view of the top plate are shown in FIGS. 4 and 5 respectively. Top plate 52 has four pie-shaped openings 56 formed therein as well as a number of bolt holes for bolting the device together. Openings 56 correspond in shape and size to the pie-shaped openings 46 formed in the bottom plate 42 but are not arranged in the same pattern 50. Vertical support plates 53 are bolted to both top plate 52 and bottom plate 42. The bottom surface 54 of top plate 52 must be smooth for a purpose to be discussed.

Figure 7:
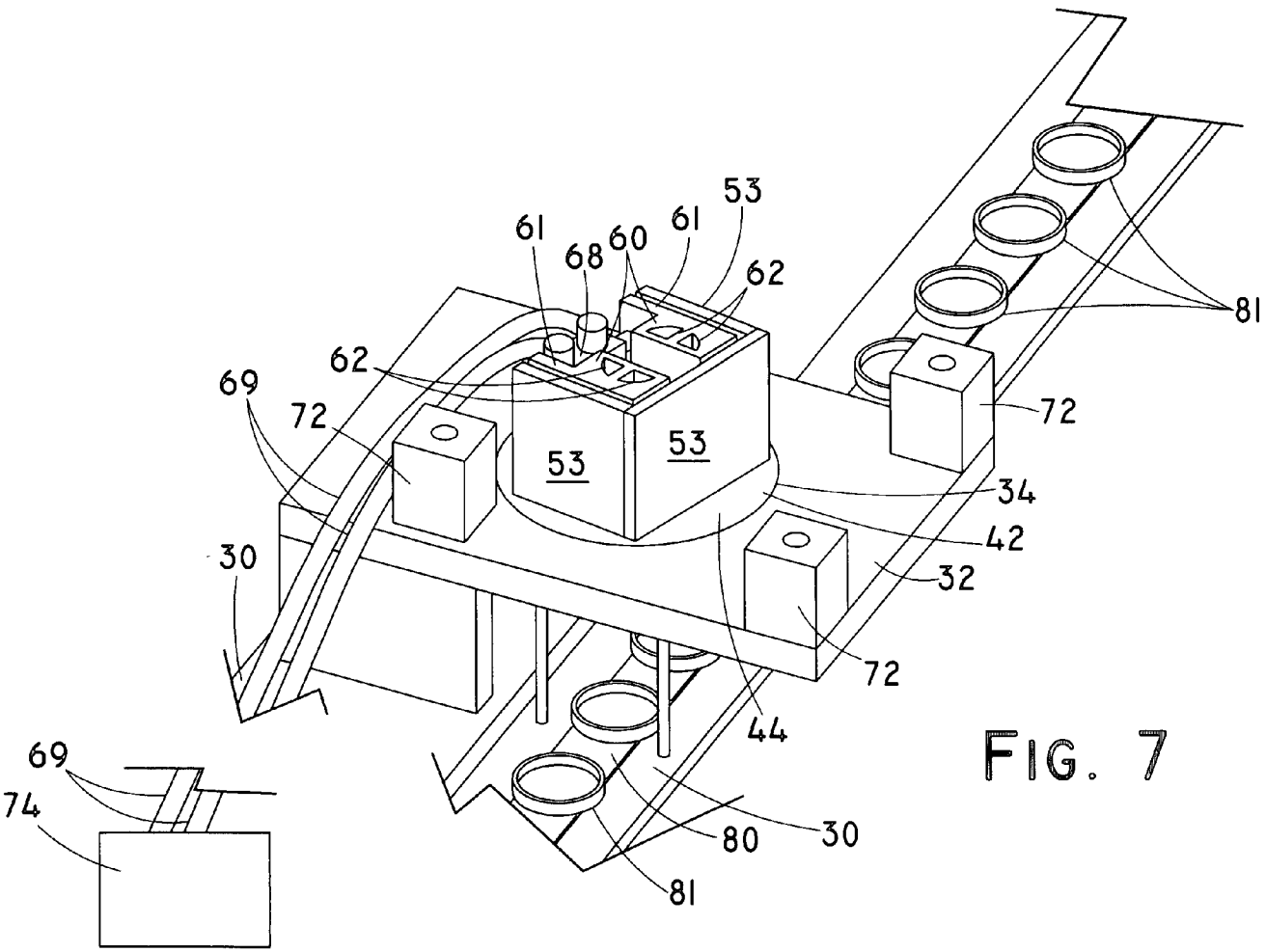
FIG. 7 is a perspective view of a portion of the apparatus with the top plate removed to clearly disclose the shuttles.
Figure 8:
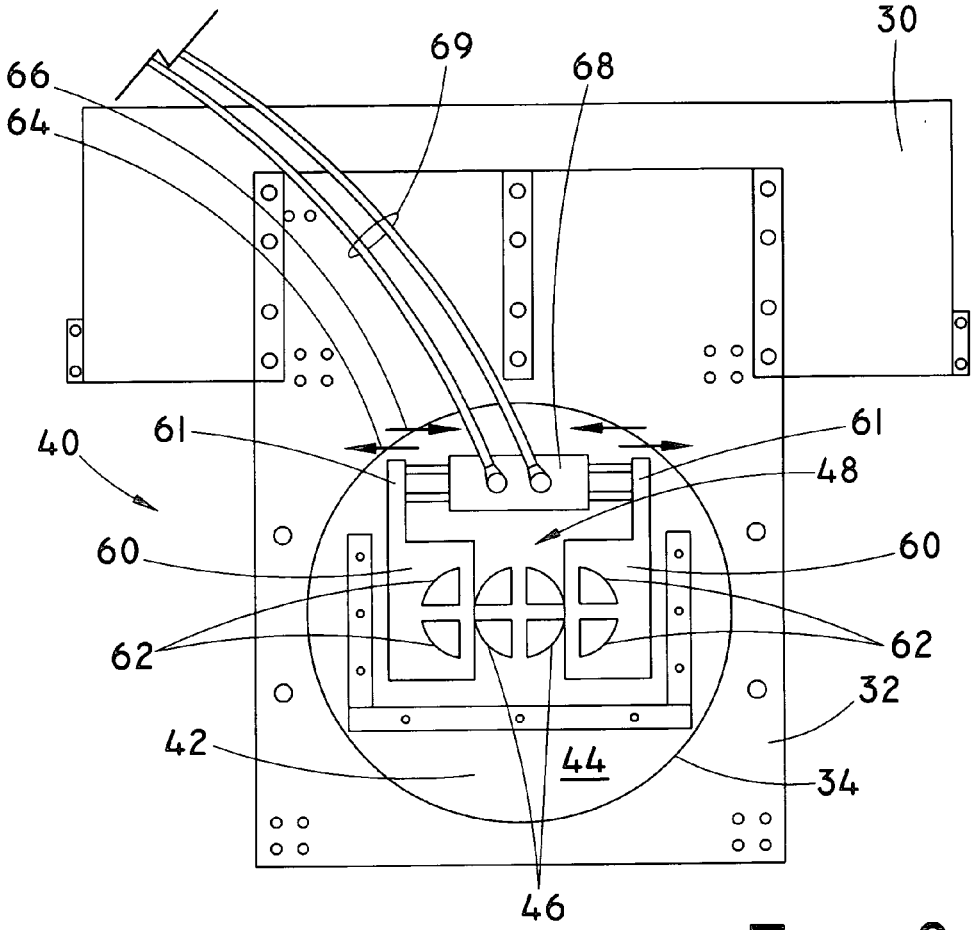
FIG. 8 is a plan view of the measuring and dispensing device with the top plate removed to disclose the shuttle members.

Referring now to FIGS. 7 and 8 which are a perspective view of the apparatus and a plan view of the measuring and dispensing device 40 respectfully, both views having the top plate 52 removed to disclose the pair of shuttle members 60. In FIGS. 7 and 8 the mounting plate 32 that is secured to the frame 30 and the three vertical support plates 53 extending upwardly from bottom plate 42 can be seen. The pair of shuttle members 60 rest on the smooth upper surface 44 of the bottom plate 42. Each shuttle member 60 has two pie-shaped shuttle openings 62 extending from its upper surface to its bottom surface. The upper and bottom surfaces of the shuttle members 60 must be smooth. As seen in FIGS. 7 and 8 the shuttle members 60 are in their first or separated locations 64. In the first or separated locations the pie-shaped shuttle openings 62 are aligned with the pie-shaped openings 56 of top plate 52 such that product can flow through openings 56 into openings 62. Each shuttle member 60 has an integral arm 61 extending there from between which the mechanism for reciprocating the shuttles is located. The preferred mechanism for reciprocating the shuttles is a pneumatic cylinder 68, which is secured to the upper surface of bottom plate 42. The pneumatic cylinder 68 is energized by high-pressure air that flows through air lines 69. Air lines 69 are connected to an air control valve 74 (see FIG. 7) that is controlled by the apparatus control system 12. Cylinder rods that extend from pneumatic cylinder 68 are connected to the shuttle integral arms 61. When the cylinder rods are retracted the shuttles 62 are moved to the second or closed locations at which the four pie-shaped shuttle openings 62 form the pattern 50 and are aligned with the four pie-shaped openings 46 in the bottom plate 42 such that product can flow from the shuttle apertures 62 through the bottom plate openings 46 in the bottom plate into the multiple-chamber container 20.

As can be best seen in FIG. 7 the mounting plate 32 is supported above the frame surface over which the belt conveyor 80 runs. The conveyor 80 is driven by a stepper-motor (not shown) that is controlled by the apparatus control system 12. The belt conveyor has a plurality of cups 81 secured thereto that receive the multiple-chamber containers 20. The conveyor is located relative to the measuring and dispensing device 40 such that the conveyor can be stopped with the container chambers precisely aligned with the four pie-shaped openings 46 in the bottom plate 42. The cups 81 have an upstanding peripheral edge and a ridge protruding from their bottom surface. The multiple-chamber containers 20 are received within the peripheral edge of the cups and when placing a container in a cup the container is rotated such that protruding ridge of the cup is seated in a concave groove formed in the bottom surface of the multiple-chamber container 20. This properly aligns the pie-shaped openings 46 in the bottom plate 42 with the individual chambers 210*f* the containers 20. Multiple-chamber containers 20 are available from several suppliers and the ridge protruding from the bottom surface are not uniformly located. Proper alignment can be obtained by rotating the bottom plate 42 in the groove formed in aperture 34.

Figure 9:
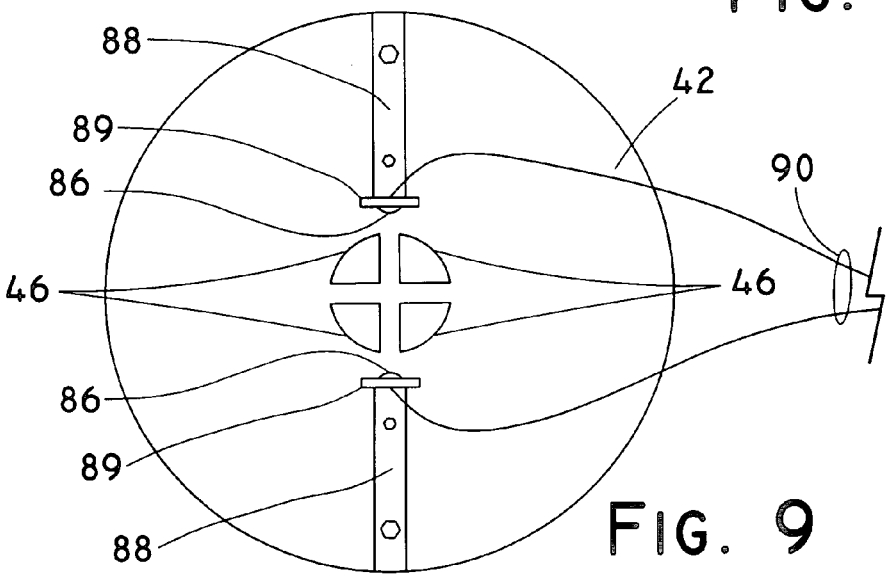
FIG. 9 is a bottom view of the bottom plate.

FIG. 9 is a bottom view of the bottom plate 42. Sensing mechanism 86 for recognizing when a multiple-chamber container 20 is in position to be filled is also shown in FIG. 9. A pair of mounting plates 88 are secured to the bottom surface of the bottom plate 42 at diametrically opposite locations. The mounting plates 88 carry downwardly extending bars 89 that have the sensing mechanisms 86 at their lower extremity. Wires 90 extend from the sensing mechanism 86 to the apparatus control system 12.

The operation of apparatus will now be discussed. The four product feed devices 70 would be mounted in their respective mounting blocks 72 and the four flexible feed conduits 73 would be fixed to the circular bores 59 formed in the transition block 58. The product feed devices 70 would be filled with the products to be dispensed. The product contained in the product feed devices 70 feed by gravity through the flexible feed conduits 73 into the circular bores 59 formed in the transition block 58. The circular bores 59 are aligned with the pie-shaped openings 56 formed in the top plate 52. At the starting stage of operation the pie-shaped openings 56 are aligned with the shuttle apertures 62 of the pair of shuttle members 60. Thus, at the starting stage since the circular bores 59, pie-shaped openings 56 and shuttle apertures 62 are aligned the product from the product feed devices 70 flows into and fills the shuttle apertures 62. The shuttles at the starting stage of operation are in their first location 64 at which position the bottoms of the shuttle apertures 62 are closed by the bottom plate 42. The height of the shuttles 60 are such that each shuttle apertures 62 has a volume that is equal to the volume of product that it is desired to be dispensed into an individual chamber 21 of the multiple-chamber container 20. The volume of the transition block bores 59 also have a volume that is equal to the volume of product that it is desired to be dispensed into an individual chamber 21. As a result at the starting stage of the operation the shuttle apertures 62 are filled with the volume of product that it is desires to be dispensed into the multiple-chamber container and the transition block bores are filled with the volume of product that will be required for the next cycle. Also, at the starting stage the conveyor 80 has been supplied with a number of multiple-chamber containers 20. The multiple-chamber containers 20 are placed in the cups 81 with the concave groove formed in their bottom surface receiving the ridge protruding from the bottom surface of cups 81. This assures that one of the vertical walls of an individual chamber 21 will be properly aligned with the sensing mechanism 86. The bottom 42 can be rotated in the aperture 34 formed in the mounting plate 32 to properly align a vertical wall of an individual chamber 21 with the sensing mechanism 86. As the operation continues an operator can restore containers 20 to the conveyor 80 to replace those that have been filled and discharged from the conveyor 80.

The apparatus 12 is thus energized with the shuttle apertures 62 filled with the appropriate volume of product and the conveyor stocked with empty multiple-chamber containers 20. Energizing the apparatus causes the apparatus control system 12 to send a signal to the stepper motor that drives conveyor 80. As the first multiple-chamber container 20 approaches the container filling location 48 it is recognized by the sensing mechanism 86 and the apparatus control system sends a signal to the conveyor stepper motor causing it to stop. At this time a signal is also sent to the air control valve 74 that sends pressurized air through air line 69 to the pneumatic cylinder 68 causing the shuttles 60 to shift from their first location 64 (shuttle apertures aligned with the upper plate apertures) to their second location 66 (shuttle apertures aligned with the bottom plate apertures). During the shifting of the shuttles 60 the upper smooth surfaces of the shuttles are in engagement with the bottom smooth surface of the top plate 52 and the bottom smooth surface of the shuttles are in engagement with top smooth surface of the bottom plate 42. This engagement of the smooth surfaces insures that all of the product contained in the shuttle apertures 62 will be moved from the first location 64 to the second location 66. As this shifting begins there can be some compacting of the product in the shuttle apertures 62. When the shuttles reach their second locations 66 the product contained in the shuttle apertures 62 are aligned with the pie-shaped openings 56 in the bottom plate and the product falls by gravity through openings 56 into the individual chambers 21 of the multiple-chamber container 20. The apparatus control system 12 is programmed to allow sufficient time for the shifting and the filling of the container 20 to occur after which signals are sent to return the shuttles 60 to their first location 64 and energize the conveyor 80. This starts the next cycle.

When the shuttles 60 return to their first location 64 the shuttle apertures 62 are aligned with the top plate apertures 56 and the bores 59 formed in the transition block 58. Since the transition block bores 59 contain sufficient product to fill the shuttle apertures 62 the product can and will fall quickly from the transition block bores 59 and top plate apertures 56 into the shuttle apertures 62. The smooth cylindrical surface of the bores 59 facilitate this rapid transfer of the product into the shuttle apertures 62. The refilling of the transition block bores 59 from the product feed device 70 through the flexible feed conduit 73 need not be as rapid, however this transition can occur over the remaining time of the cycle.

It will be apparent to a person of ordinary skill in the art that embodiments of the present invention are not limited to the specific embodiment that has been illustrated and discussed herein. The apparatus of this invention can be adapted to fill multiple-chamber containers having any number of individual chambers and any volume of individual chambers. Thus, the present invention is intended to encompass all of the embodiments disclosed and suggested herein as defined by the claims as well as any equivalents thereof.

The invention claimed is:

1. An apparatus for automatically proportioning-out predetermined quantities of different products and automatically discharging the predetermined quantities into individual chambers of multiple-chamber containers that are to be filled by the apparatus; comprising:

a frame;

a mounting plate supported by said frame;

a measuring and dispensing device carried by said mounting plate, including a bottom plate supported by said mounting plate, said bottom plate having a top and a bottom surface, said bottom plate top surface being smooth, a plurality of bottom plate apertures formed in said bottom plate at a container filling location and in a pattern such that the bottom plate apertures can be aligned with each of the individual chambers of the multiple-chamber dispensing container to be filled by the apparatus, a top plate mounted on and spaced above a distance from said bottom plate, said top plate having top and bottom surfaces, said top plate bottom surface being smooth and parallel to said bottom plate smooth upper surface, a number of top plate apertures formed in said top plate, the number of top plate apertures being the same number as the plurality of bottom plate apertures, the top plate apertures being not aligned with any of the bottom plate apertures, a pair of shuttle members extending between said smooth upper and bottom surfaces and having shuttle apertures formed therein that extend from the smooth upper and bottom surfaces, the pair of shuttles being mounted to be reciprocated between a first location at which the shuttle apertures are aligned with the top plate apertures and second location at which the shuttle apertures are aligned with the bottom plate apertures, a mechanism for reciprocating the pair of shuttles;

a conveyor supported by said frame for transporting multiple-chamber containers, that are to be filled by the apparatus, to the container filling location;

a conveyor drive mechanism;

a sensing mechanism for recognizing multiple-chamber containers on the conveyor; and an apparatus control system for receiving signals from said sensing mechanism and stopping the conveyor with a multiple-chamber container at the container filling location, the apparatus control system also energizes the mechanism for reciprocating the pair of shuttles in response to receiving the signal that the multiple-chamber container has been recognized, the apparatus control system is programmed to energize the conveyor drive mechanism to initiate a new cycle at a predetermined time after the conveyor was stopped.

2. An apparatus as set forth in claim 1 wherein:

said shuttle apertures each have a volume equal to the volume of the individual chambers of the multiple-chamber container to be filled.

3. An apparatus as set forth in claim 1 wherein the apparatus further includes:

a product feed device for each individual chamber of the multiple-chamber container that is to be filled; and each product feed device being adapted to supply product to one of said top plate apertures.

4. An apparatus as set forth in claim 2 wherein the apparatus further includes:

a product feed device for each individual chamber of the multiple-chamber container that is to be filled; and each product feed device being adapted to supply product to one of said top plate apertures.

5. An apparatus as set forth in claim 2 wherein the apparatus further includes a transition block secured to the upper surface of said top plate; and a plurality of bores formed in said transition block that are aligned with said top plate apertures that are adapted to receive product from said product feed device for providing a stored head of product for delivery through said top plate apertures.

6. An apparatus as set forth in claim 4 wherein the apparatus further includes a transition block secured to the upper surface of said top plate; and a plurality of bores formed in said transition block that are aligned with said top plate apertures that are adapted to receive product from said product feed device for providing a stored head of product for delivery through said top plate apertures.

7. An apparatus as set forth in claim 5 wherein:

each of said plurality of bores formed in said transition block has a volume equal to the volume of the individual chambers of the multiple-chamber containers to be filled.

8. An apparatus as set forth in claim 6 wherein:

each of said plurality of bores formed in said transition block has a volume equal to the volume of the individual chambers of the multiple-chamber containers to be filled.

9. A method of automatically proportioning-out predetermined quantities of different products and automatically discharging the predetermined quantities into individual chambers, arranged in a pattern, of multiple-chamber containers that are to be filled by the apparatus; comprising the following steps:

providing a feed device for the product to be discharged into each individual chamber;

filling each feed device with the product that is to be discharged into each individual chamber;

providing a plurality of shuttles that have bores formed therein having volumes equal to the volume of the individual chambers of the multiple-chamber containers to be filled;

providing a plate having a plurality of apertures formed therein arranged in the pattern of the multiple-chamber container;

resting said plurality of shuttles on said plate at locations at which the bores of said shuttles are not aligned with the apertures formed in the plate;

locating a multiple-chamber container below said plate with the pattern of the apertures formed in the plate aligned with the pattern of the individual chambers of the multiple-chamber container;

feeding product from each feed device to the bores formed in said shuttles;

sliding said shuttles on said plate to a location at which the pattern of apertures formed in the plate are aligned with the pattern of individual chambers of the multiple-chamber container;

allowing the product contained in the bores of the shuttle to fill the individual chambers of the multiple-chamber container.

10. The method as set forth in claim 9 wherein the following additional steps are performed:

providing a transition block having a bores formed therein corresponding to each bore formed in the shuttles extending between the feed devices and the shuttles;

filling the bores formed in the transition block with product from the feed devices;

sliding said shuttles on said plate from the location at which the pattern of apertures formed in the plate are aligned with the pattern of individual chambers of the multiple-chamber container to the location at which the bores of said shuttles are not aligned with the apertures formed in the plate and are aligned with the bores formed in the transition block;

filling the bores of the shuttle with product contained in the bores formed in the transition block.

11. The method as set forth in claim 9 wherein the following additional step is performed:

providing a stepper-motor driven conveyor to locate said multiple-chamber containers below said plate with the pattern of apertures that align with the pattern of the individual chambers of the multiple-chamber containers.

12. The method as set forth in claim 10 wherein the following additional step is performed:

providing a stepper-motor driven conveyor to locate said multiple-chamber containers below said plate with the pattern of apertures that align with the pattern of the individual chambers of the multiple-chamber containers.

13. The method as set forth in claim 9 wherein the following additional step is performed:

rotating said plate having a plurality of apertures arranged in the pattern of the multiple-chamber container to provide proper alignment with the chambers of the multiple-chamber container.

14. The method as set forth in claim 10 wherein the following additional step is performed:

rotating said plate having a plurality of apertures arranged in the pattern of the multiple-chamber container to provide proper alignment with the chambers of the multiple-chamber container.

15. The method as set forth in claim 12 wherein the following additional step is performed:

rotating said plate having a plurality of apertures arranged in the pattern of the multiple-chamber container to provide proper alignment with the chambers of the multiple-chamber container.

* * * * *